United States Patent [19]

Woods

[11] 4,270,991

[45] Jun. 2, 1981

[54] ANODIC OXIDATION OF ALUMINUM AND ALUMINUM ALLOYS WITH A LIGNIN ELECTROLYTE SOLUTION

[76] Inventor: Jack L. Woods, 1517 Ninth, Ogden, Utah 84404

[21] Appl. No.: 799,010

[22] Filed: May 20, 1977

[51] Int. Cl.[3] ..... C25D 11/08; C25D 11/10

[52] U.S. Cl. ..... 204/58

[58] Field of Search ..... 204/58

[56] References Cited

U.S. PATENT DOCUMENTS 3,146,178 8/1964 Cochran et al. ..... 204/58

FOREIGN PATENT DOCUMENTS 636293 4/1950 United Kingdom .

OTHER PUBLICATIONS

"Surface Treatment of Al", by S. Wernick et al., 1964, pp. 338, 347.

Metals Handbook, 8th Edition, vol. 2, *Heat Treating, Cleaning and Finishing,* American Society for Metals, Ohio, pp. 620 to 623 (Copyright 1964).

*Primary Examiner*—R. L. Andrews

[57] ABSTRACT

Aluminum and its alloys are anodized with a hard finish by enhancing the anodizining electrolyte solution with a lignin or lignosulfonate salt.

8 Claims, No Drawings

ANODIC OXIDATION OF ALUMINUM AND ALUMINUM ALLOYS WITH A LIGNIN ELECTROLYTE SOLUTION

BACKGROUND OF THE INVENTION

This invention related to a process for anodizing aluminum and its alloys with a hard finish. More particularly this invention relates to a process for hard anodizing of aluminum and its alloys wherein the anodizing electrolyte is enhanced by the addition of lignin or a lignosulfonate salt.

It is well known in the art to provide for the anodic oxidation of aluminum and its alloys with an acid electrolyte such as sulfuric acid, oxalic acid, chromic acid, sulfamic acid and phosphoric acid to produce a hard corrosion resistant layer. More recently it has been proposed to utilize an addition along with the anodizing electrolyte. For example U.S. Pat. No. 2,855,350 utilizes 2-aminoethyl sulfuric acid as an additive to allegedly produce a thick dense hard oxide coating. Similarly U.S. Pat. No. 2,855,351 adds taurine (2-aminoethane sulfuric acid) and amino substituted taurines to also allegedly produce thicker, denser and harder oxide coatings than are produced by the conventional acid electrolyte. The next consecutively numbered patent U.S. Pat. No. 2,855,352 issued to the same inventor and assignee claims that sulfamic acid ($NH_2SO_2H$) and its substituents also produce the same effects as the previously mentioned patents.

About the same time a different invention having the same assignee alleged in U.S. Pat. No. 2,897,125 that a surface active agent added to the electrolyte gave improved results with an aqueous extract of lignite, brown coal or peat. The extract is stated on column 3, line 25 to have 4.5 to 5% nitrogen content. Similarly in U.S. Pat. No. 2,905,600 the same inventor discovered improved anodization with a peat extract containing 4.5 to 5% nitrogen in two steps anodizing process.

In a continuation-in-part U.S. Pat. No. 2,977,294 the same inventor utilized a two bath anodization process wherein the first bath contains a peat extract containing 4.5 to 5% nitrogen residue.

It is claimed in U.S. Pat. No. 3,434,943 that superior anodizing results are obtained by adding to the electrolyte bath an extract obtained by treating the quebracho tree with water. The patentee allegeded that this extract contained a derivative of orthodihydroxy benzine but did not wish to be held to any formula. According to The Condensed Chemical Dictionary, Sixth Edition, the chief constituents of the quebracho tree are aspidospermine $C_{22}H_{30}O_2N_2$ which is an alkaloid, tannin $C_{14}H_{10}O_4$ and yohimbrine $C_{21}H_{26}O_3N_2$. Aspidospermine and yohimbine are both alkaloids.

A common functional or active group in all the above mentioned additives is nitrogen. Many of the compounds contain an amino group. Peat contains 2 to 3% ammonia and about 22% humus acids which have soluble nitrogen compounds.

While these compounds have been somewhat effective as additives, there are others which are superior.

OBJECTS AND DESCRIPTION OF THE INVENTION

It is an object of the present invention to provide an additive to an anodizing both which does not contain nitrogen.

It is also an object of the present invention to provide an additive to an anodizing electrolyte bath wherein the hardness of the layer deposited upon aluminum and its alloys is greatly enhanced.

These and other objects are illustrated by the description and claim that follow.

It has now been found that if lignin and its acids and salts of acids are added to an acidic anodizing electrolytic bath that the deposition of metal oxide on the aluminum surface will be thick and hard. It has also been found that when using a lignin or linigin derivative that the anodizing process may be carried out by a constant current. Some prior art patents teach a plurality of voltage steps or increasing the voltage in steps. In the present invention more rapid coating formation is made possible by holding the anodizing current essentially constant by increasing the voltage as required.

Another distinct advantage of the present invention is that hard anodizing may be carried out without the use of surfactants or wetting agents in the anodizing electrolyte solution.

Lignin is a non-carbohydrate polymer obtained by the digestion of wood. The structure of lignin has not been entirely elucidated so any attempt to formulate an exact formula herein would be self limiting and possibly incorrect. Lignin, along with cellulose, are the major constituents forming the skeleton of trees and other word substances. It has been hypothesized that lignin has the same elements as cellulose but its exact composition is unknown. Lignin is obtained by the digestion of wood with aqueous alkali and alkaline bisulfites. According to standard texts there is no unequivocal evidence that native lignin can be dissolved in inert solvents and a strong case can be constructed for the view that native lignin may have a simple repetitive structure which is chemically modified during solubilizing processes. Degradation studies of lignin have produced the following compounds:

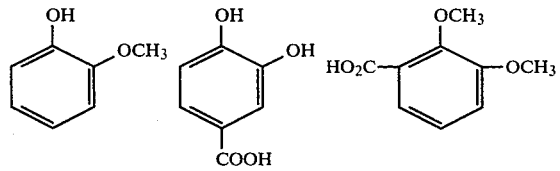

Guafacol | Protocatechuic Acid | Isohemipinic Acid

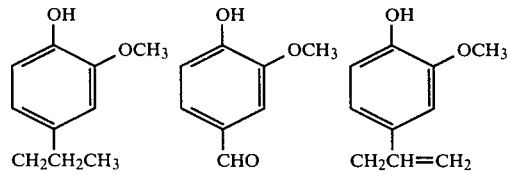

4-n-propyl guaiacol | Vanillin | Eugenol

Such studies have lead researchers to postulate that lignin has the following basic repeating unit

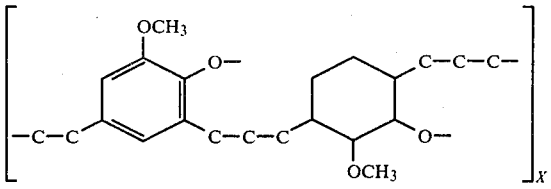

wherein X can be any number to form the polymer.

Consideration of the oxygen content of lignin has lead researchers to hypothesize that the above shown three carbon units must be in the same oxidation state as glycerol with the following formulas wherein Ar

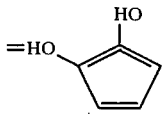

being possible.

Many monomers can be created from this structure including $ArCHOHCCHOHCH_2OH$
$ArCHOHCH_2CHO$
$ArCH_2CHOHCHO$
$ArCOCHOHCH_2OH$
$ArCHOHCOCH_3$
$ArCH_2COCH_2OH$
$ArCOCH_2CH_2OH$
$ArCOCHOHCH_3$ There are two basic processes to remove lignin from wood as a water soluble derivative in the manufacture of paper. In the sulfite process, an alkaline bisulfite solution sulfonates some of the aromatic nuculi to form ligno sulfonates. Guaiacol may be used in the following example:

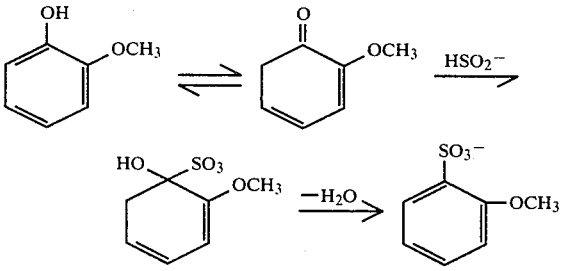

It will be noted from the above structural formulas that nitrogen is not involved in any way as an active element. It is also obvious that the structure of lignin, its acids and salts are not well established. One skilled in the art knows how to extract lignin from cellulose and other plant constituents but the reducing of lignin to a specific formula has not been established with sufficient clarity to go beyond using the term "lignin", "ligno sulfonic acid" and "ligno sulfonate salt". These terms are understood by those working in the art.

Lignin is easily sulfonated to form the corresponding sulfonic acid. This compound and its salts constitute ideal addition agents for hard anodizing electrolytes as will be hereinafter demonstrated. Any form of lignin which is soluble in an acid electrolyte is within the scope of this invention. Examples of such salts are the sodium, potassium and ammonium lignosulfonate salts. The ammonium ion is not active nitrogen group as taught in this invention and serves only to neutralize the lignin sulfonic acid.

The ligno sulfonate salts are especially useful because they can be ground into a powder where they can be easily stored until ready for use. While any lignin, ligno sulfonic acid or ligno sulfonate salt may be used the ammonium and sodium salts are preferred.

It has been shown that the electrolyte, within reasonable bounds, has very little effect upon the ligno sulfonate. During laboratory testing it was shown that concentrations of sulfuric acid varying from 125 grams to 350 grams per liter performed satisfactorily with a lignin derivative concentration varying from 0.5 to 5.0 grams per liter. The five gram figure was an arbitrary limit as there does not seem to be any maximum concentration inside the bounds of solubility at which the lignin derivative will function. It has been noted however, that concentration below about 0.25 grams per liter do not function in a satisfactory manner.

The same range of concentration appears to work equally well with any acid electrolyte. For example oxalic acid or mixtures of oxalic and sulfuric acid could be used equally well. For example solutions using 150 grams of sulfuric acid and 14 grams per liter of oxalic acid have been used as has a solution utilizing 60 grams of oxalic acid per liter.

Reaction conditions, while not extremely critical, do seem to function best at low temperatures. The temperature may vary from 10° C. down to the freezing point of the solution. Optimum temperatures seem to be about 0° C.

The invention is illustrated by the examples below. These examples are not considered to limit the invention in any way but to demonstrate the usefulness of the invention.

All of the tests were conducted in a twelve gallon stainless steel tank using the tanks as cathodes. Aluminum samples to be tested were 4"×4" square and ⅛" thick. They were connected to the anode of a direct current power supply by attaching them to eight inch long pieces of 1100 alloy aluminum wire.

EXAMPLE 1

An electrolyte bath containing 175 grams of sulfuric acid was employed without any lignin additive. The anodizing was started using a current of 2.0 amps which was gradually increased over a three minute time period to 8.5 amps which equates to 36 amps per square foot. The electrolyte was maintained at 2° C. Almost immediately, with the voltage constant, the current drastically increased. The power supply was immediately shut off and the aluminum plate was taken from the anodizing cell and examined. The plate had started "burning" on three of the four corners. Metal was eroded away with no appreciable anodic coating being formed.

EXAMPLE 2

The conditions noted in Example 1 were repeated with the exception that 0.25 grams per liter of sodium ligno sulfonate were added to the electrolyte. The anodizing operation progressed satisfactorily for about 19 minutes at which time the current started to increase at a rapid rate, which is an indication of burning. The power supply was shut off and the aluminum sample was examined. The anodic coating was satisfactory with a minor indication of erosion beginning on one corner. A hard coating thickness of 0.8 mils had been formed.

EXAMPLE 3

An electrolyte bath was formed containing 250 grams per liter of sulfuric acid and 0.5 grams per liter of ammonium ligno sulfonate. The anodizing process was carried out according to the previous examples. The anodizing proceeded normally for approximately 24 minutes when the amp meter indicated burning. The current was turned off and the aluminum sample was analyzed. A very small spot on one edge showed an indication of heat where burning was just starting. The hard anodic coating had a thickness of 1.0 mil.

EXAMPLE 4

The concentration of sodium ligno sulfonate was raised to 1.0 grams per liter and the sulfuric acid in the electrolyte was raised to 350 grams per liter. The anodizing process proceeded as described. The experiment was terminated when the power supply ran out of voltage at 98 volts. The anodizing time was 78 minutes and the anodic coating had a thickness of 3.8 mils. The coating was very hard and there was no indication of burning.

EXAMPLE 5

The procedure of Example 4 was repeated using 5 grams per liter of sodium ligno sulfonate and 250 grams per liter of sulfuric acid. The only variation noted was that the anodizing time was 79 minutes and the coating had a thickness of 3.9 mils.

EXAMPLE 6

The electrolyte in this Example was 150 grams of sulfuric acid and 14 grams of oxalic per liter. To this electrolyte mixture was added 1.0 grams per liter of sodium ligno sulfonate. Essentially the same outstanding results given in Example 5 were obtained.

EXAMPLE 7

Anodizing was carried out as in Example 1. The electrolyte used contained 250 grams of sulfuric acid per liter and 1.0 grams per liter of sodium ligno sulfonate. The experiment utilized aluminum alloy 7075 0.5% Si, 0.7% Fe, 1.1–2.0% cu, 0.3 Mn, 2.1–2.9 Mg, 5.1–6.1% with the remainder being aluminum as the test plate. The power supply reached a terminal voltage of 98 volts after 89 minutes. The coating formed was hard and had a thickness of 4.4 mils.

In all experiments except Example 7 aluminum alloy 2024 was used since those skilled in the art realize that the 2024 alloy is extremely difficult to hand anodize with conventional anodizing processes. Aluminum alloy 2024 consists of 0.5 Si, 0.5 Fe, 3.8–4.9% cu, 0.6% Mn and 1.2–1.8 Mg with the remainder being aluminum.

The problem with using conventional anodizing techniques is aptly illustrated in Example 1. Aluminum alloy 2024 could be replaced by aluminum or any other aluminum alloy and the same novel results could be obtained. In fact several other experiments with other alloys have been carried out and various electrolyte temperatures up to 10° C. with the same excellent results being obtained. However, it is believed that the above examples are sufficient to illustrate the invention.

Of significant interest is the benefit of a lignin in forming a hard anodizing product using a high pulsing current as taught in U.S. Pat. No. 3,857,776. The pulsing current stabilizes the oxide formation and the concentration of lignin can be considerably reduced bearing in mind that in Example 2 about 0.25 grams per liter of lignin was only marginally beneficial. However, on a general basis a high pulsing current will produce better results with less lignin.

Although the invention as has been described is deemed to be that which would form the preferred embodiment of the invention, it is recognized that departures may be made therefrom without departing from the scope of the invention which is not limited to the details disclosed, but is to be accorded the full scope of the claims so as to include any equivalent processes.

What is claimed is:

1. An electrolyte process for hard anodizing aluminum and aluminum alloys which comprises making an aluminum or aluminum alloy article anode in an acid electrolyte solution containing between 0.50 and 5.0 grams per liter of electrolyte solution of a lignin selected from the group consisting of lignin, a ligno sulfonic acid and a ligno sulfonate salt and an acid concentration between 60 and 350 grams per liter at a temperature between the freezing point of the electrolyte solution and 10° C.

2. A process according to claim 1 wherein the current is a direct current.

3. A process according to claim 2 wherein the lignin is a lignin extracted from wood.

4. A process according to claim 2 wherein the lignin is a ligno sulfonic acid.

5. A process according to claim 4 wherein the lignin is a salt of a ligno sulfonic acid.

6. A process according to claim 5 wherein the lignin is a sodium ligno sulfonate.

7. A process according to claim 5 wherein the lignin is an ammonium ligno sulfonate.

8. A process according to claim 1 wherein the current is a pulsated direct current.

* * * * *